United States Patent [19]

Pav et al.

[11] Patent Number: 4,685,390

[45] Date of Patent: Aug. 11, 1987

[54] CALENDER WITH EXCHANGEABLE ROLLS

[75] Inventors: Josef Pav; Reinhard Wenzel, both of Krefeld; Peter Svenka, Grefrath; Richard Rauf, Krefeld, all of Fed. Rep. of Germany

[73] Assignee: Kleinewefers GmbH, Krefeld, Fed. Rep. of Germany

[21] Appl. No.: 726,131

[22] Filed: Apr. 23, 1985

[30] Foreign Application Priority Data

May 2, 1984 [DE] Fed. Rep. of Germany ..... 3416212

[51] Int. Cl.[4] ..... B30B 3/04

[52] U.S. Cl. ..... 100/168; 100/170; 100/162 R; 72/239

[58] Field of Search ..... 100/155 R, 168, 170, 100/176, 162 R, 47; 72/239, 238

[56] References Cited

U.S. PATENT DOCUMENTS

| | | | |
|---|---|---|---|
| 639,974 | 12/1899 | Harley et al. | 100/162 R |
| 3,180,125 | 4/1965 | O'Brien | 72/239 |
| 3,244,090 | 4/1966 | Bischoff | 100/162 R |
| 4,168,660 | 9/1979 | Zelle | 100/168 X |
| 4,395,944 | 8/1983 | Siepermann et al. | 72/239 X |

FOREIGN PATENT DOCUMENTS

| | | |
|---|---|---|
| 14102 | 12/1893 | Fed. Rep. of Germany . |
| 1054952 | 10/1959 | Fed. Rep. of Germany . |
| 1561730 | 7/1970 | Fed. Rep. of Germany . |
| 2201630 | 7/1973 | Fed. Rep. of Germany . |

*Primary Examiner*—Peter Feldman

*Attorney, Agent, or Firm*—Peter K. Kontler

[57] ABSTRACT

A calender wherein a permanently installed main roll cooperates with at least one exchangeable roll to provide a nip for the passage of a web of paper or the like. The end portions of the exchangeable roll are mounted in bearings which are insertable into and extractible from sockets provided in levers which are pivotably mounted in the frame of the calender. The calender has a transporting unit which is provided with grippers for the bearings and with motors which reciprocate the grippers to extract the bearings from their sockets after the levers are pivoted to positions in which the exchangeable roll is spaced apart from the main roll. The transporting unit thereupon transfers the exchangeable roll onto a mobile rack which can be transported to a station where the exchangeable roll is repaired. The same rack or a discrete second rack can deliver a refurbished exchangeable roll to the transporting unit for introduction of the bearings on the refurbished roll into the sockets on the levers in the frame of the calender before the levers are pivoted to move the refurbished roll into engagement with a running web or with the main roll. Locking devices are provided to releasably hold the bearings in their sockets, and additional locking devices are provided to releasably hold the bearings in sockets which are provided on the rack or racks. The transporting unit can constitute a robot whose grippers then constitute effectors and whose operation is automated to start a roll exchanging operation as soon as one or more sensors in the calender ascertain that the quality of the exchangeable roll is unsatisfactory for further treatment of running webs.

42 Claims, 7 Drawing Figures

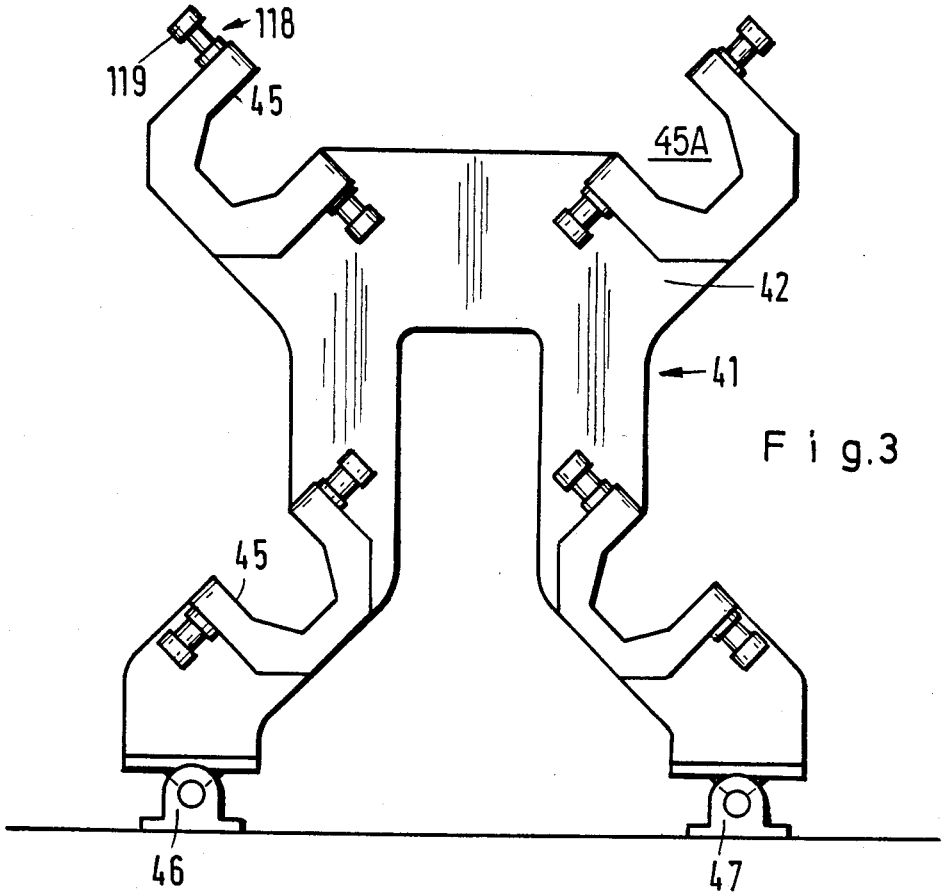
Fig.3
Fig.4
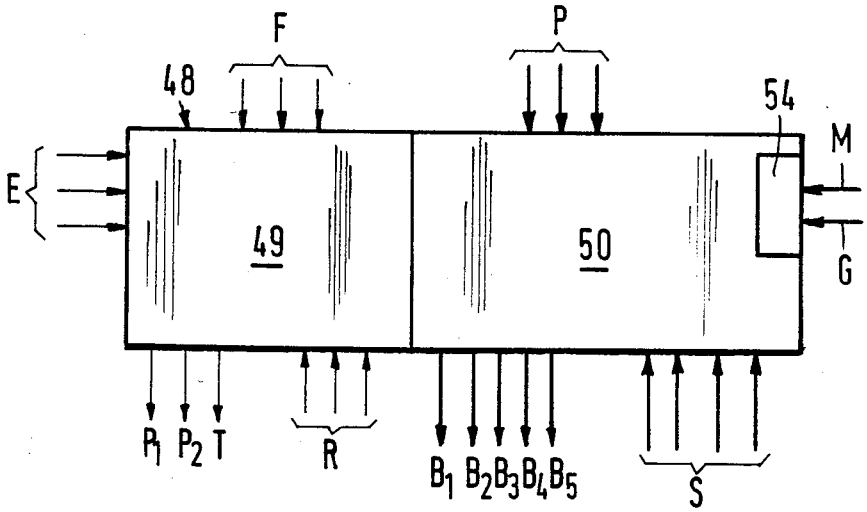

CALENDER WITH EXCHANGEABLE ROLLS

BACKGROUND OF THE INVENTION

The present invention relates to calenders and analogous machines which employ roll assemblies, and more particularly to improvements in calenders with exchangeable rolls.

It is already known to install one or more rolls of an assembly of rolls in a calender in such a way that the end portions of at least one roll are held in bearings and the bearings are movable with the one roll between a first position in which the one roll cooperates with one or more neighboring rolls to treat webs or sheets of paper, textile material or the like and a second position in which the one roll is spaced apart from the neighboring roll or rolls. German Auslegeschrift No. 11 13 357 discloses a calender wherein the roll assembly comprises a centrally located main roll and a cluster of four additional rolls, two at a level above and two at a level below the main roll. The main roll has an elastomeric outer layer and is removably installed in the frame of the calender. To this end, the main roll is loosely held between the two upper and the two lower additional rolls, the upper additional rolls can be lifted above and away from the main roll and the lower additional rolls are mounted in the frame of the calender for rotation about fixed axes. Hydraulic cylinder and piston units are provided to normally bias the upper additional rolls downwardly toward the main roll. In order to remove the main roll from the frame of the calender, the upper additional rolls must be lifted above and away from the main roll, a wagon with a vertically movable trough-shaped support is moved below the main roll, the support is caused to move upwardly so as to lift the main roll off the lower additional rolls, and the wagon or its support is thereupon moved to withdraw the lifted main roll from the frame of the calender. A fresh or restored main roll is introduced into the calender by reversing the aforedescribed sequence of steps. In order to prevent axial displacements of the main roll relative to the wagon, the latter is provided with vertically adjustable centering cones which are mounted on pivotable beams.

The just described mode of removing a roll from the frame of a calender is feasible only when the removable roll is the main roll of an assembly of several rolls and if the remaining (additional) rolls are installed in the frame in a specific way, namely with the two lower additional rolls fixed, with the two upper additional rolls movable upwardly and away from the lower additional rolls, and with the main roll simply nested between the upper and lower additional rolls. Another drawback of the proposal in the German Auslegeschrift is that the trough is likely to damage the elastomeric layer of the main roll.

OBJECTS AND SUMMARY OF THE INVENTION

An object of the invention is to provide a calender wherein one or more rolls can be exchanged in a novel and improved way.

Another object of the invention is to provide a calender wherein two or more rolls can be exchanged in a simultaneous operation.

A further object of the invention is to provide a calender with novel and improved means for effecting rapid, simple and gentle exchange of one or more rolls.

An additional object of the invention is to provide a calender which is constructed and assembled in such a way that it allows for convenient exchange of rolls which are not accessible from below or which can be exchanged regardless of whether or not they are accessible from below.

A further object of the invention is to provide a novel and improved frame for use in a calender of the above outlined character.

An additional object of the invention is to provide a calender wherein the exchange of one or more rolls can take place semiautomatically or in a fully automatic way and wherein the exchange of rolls can be initiated and carried out in automatic response to development of the need to exchange one or more rolls for the purpose of inspection, repair or replacement.

Another object of the invention is to provide a calender wherein one or more rolls can be exchanged, either automatically or semiautomatically, irrespective of whether they carry sensitive external coatings or comprise shells made of a hard and rigid material.

A further object of the invention is to provide a novel and improved method of exchanging rolls in a calender or an analogous machine.

One feature of the invention resides in the provision of a calender which comprises a main frame, at least one exchangeable roll normally installed in the frame and having spaced-apart first and second end portions, bearings provided on and rotatably surrounding the end portions of the exchangeable roll, sockets for the bearings provided in the frame and having open sides permitting insertion and withdrawal of the respective bearings, locking means actuatable to releasably hold the bearings in the respective sockets, grippers movable into and from engagement with the bearings, and means for moving the grippers with reference to the frame so as to move the bearings into and out of the respective sockets. The calender preferably further comprises actuating means for moving the locking means between operative and inoperative positions in which the bearings are respectively held in and are removable from or insertable into the respective sockets. Each of the bearings preferably comprises a specially designed portion (hereinafter called head) and the grippers are movable into and from motion transmitting engagement with the heads of the respective bearings. The calender preferably further comprises drive means for moving the grippers into and from engagement with the respective heads and such drive means are preferably provided on the moving means. The moving means can comprise a support for each of the drive means and means for reciprocating the supports along predetermined paths. Control means can be provided for effecting the operation of the actuating means, drive means and reciprocating means in a predetermined sequence to partially or fully automate the insertion of bearings into or withdrawal of bearings from the respective sockets.

The grippers can constitute the effectors of a robot and the calender then preferably further comprises signal generating sensor means for monitoring the movements of the grippers. The sockets preferably include seats which taper in directions away from the respective open sides and the bearings are preferably provided with complementary portions which are snugly receivable in the respective seats. The bearings are preferably further formed with shoulders which are adjacent to the respective heads and the locking means are preferably mounted on the respective sockets and are actuatable to move into and out of engagement with the shoulders of the respective bearings.

Another feature of the invention resides in the provision of a calender which comprises a main frame, a roll assembly including a main roll in the frame and at least one exchangeable roll having first and second end portions, means for shifting the exchangeable roll in at least substantial parallelism with the main roll between a first position of engagement with and a second position remote from the main roll, bearings provided on the end portions of the exchangeable roll, sockets removably receiving the bearings, grippers movable into and from engagement with the bearings, and means for moving the grippers with reference to the frame so as to move the bearings into and out of the respective sockets. The sockets are preferably mounted in the shifting means so that they share the movements of the exchangeable roll between its first and second positions. The grippers are arranged to engage the respective bearings in the second position of the exchangeable roll. The shifting means can comprise a holder for each of the sockets and motor means for moving the holders with reference to the main roll and the frame of the calender. The motor means preferably comprises at least one fluid-operated (preferably hydraulic) motor which can also serve as a means to urge the exchangeable roll against the main roll with a variable force. Each of the holders can comprise a lever which is pivotable in the frame about a fixed axis.

The main roll and the exchangeable roll define an elongated nip in the first position of the exchangeable roll and each of the sockets has a seat with an open side through which the respective bearing is insertable into and withdrawable from its seat. The seats have a common symmetry plane which preferably halves the open sides and makes an angle of less than 31° with a second plane which extends through the nip and is tangential to the rolls in the first position of the exchangeable roll.

The grippers are preferably arranged to move the exchangeable roll from a lower level to a higher level during extraction of the bearings from the respective sockets.

The roll assembly preferably comprises a plurality of exchangeable rolls and the calender preferably further comprises means for jointly transporting the exchangeable rolls with reference to the main roll subsequent to shifting of the exchangeable rolls to their second positions. For example, the roll assembly can comprise four parallel exchangeable rolls each of which defines with the main roll an elongated nip when it assumes the first position. The transporting means preferably comprises a second frame (hereinafter called framework to differentiate from the main frame of the calender) and the grippers and moving means for the grippers are mounted on such framework. The framework can comprise two interconnected sections; the grippers for the bearing for one end portion of each exchangeable roll are then provided on one of the sections and the grippers for the bearing for the other end portion of each exchangeable roll are then provided on the other section of the framework. The sections of the framework can at least partially surround the main frame of the calender. The main frame can be provided with apertures (e.g., in the form of cutouts) wherein the sockets are movable during shifting of the exchangeable rolls between their first and second positions and/or during movement of the transporting means with reference to the main frame. The calender comprises additional bearings for the end portions of the main roll and the apertures are preferably disposed at one or more levels different from the level of the main roll. For example, one or more apertures can be disposed at a level above and/or one or more apertures can be disposed at a level below the main roll. The main frame of the calender can comprise a plurality of (e.g., two) spaced-apart upright frame members and the apertures are provided in at least one of these frame members.

The upper portion of the main frame can be provided with guide means (e.g., two elongated horizontal parallel tie rods or rails) for the framework of the transporting means, and the framework is reciprocable along such guide means in parallelism with the axis of the main roll. Each section of the framework can comprise a bridge member or web which is disposed at a level above the main frame and two downwardly extending arms or flanges which are supported by the web and flank the main frame.

Alternatively, each section of the framework can comprise a bridge member or web at a level above the main frame and two elongated arms or flanges which extend downwardly from the web, which flank the main frame and whose lower end portions are movable along guide rails mounted on the floor or at a level close to the floor. Such rails are or can be parallel to the axis of the main roll.

The calender preferably further comprises at least one rack having means for receiving bearings from the grippers on the framework of the transporting means. The latter is arranged to move exchangeable rolls between a position in which the exchangeable rolls are adjacent to the sockets on the main frame and a position in which the exchangeable rolls are adjacent to the receiving means on the rack. The mutual positions of receiving means on the rack preferably correspond to mutual positions of the sockets on the main frame in the second positions of the respective exchangeable rolls. The rack is preferably a mobile rack which is movable between a plurality of different positions with reference to the main frame, and the calender preferably further comprises guide means (e.g., in the form of floor-mounted rails) defining a predetermined path for movement of the rack relative to the main frame. The station which is occupied by the main frame of the calender is preferably separated from a second station by a partition or the like, and the second station is arranged to allow for maintenance, inspection, cleaning and/or storage of exchangeable rolls. The guide means is arranged to guide the rack for movement between the two stations, and the calender preferably comprises a second rack which is also provided with means for receiving the bearings of exchangeable rolls from the grippers on the framework of the transporting means. Such calender can be further provided with means for automatically moving the racks between the first and second stations in response to initiation of the exchange of at least one exchangeable roll, e.g., in response to a signal from a sensor which monitors the condition (particularly the quality of the external surface) of an exchangeable roll. The racks preferably flank the main frame when they are located at the first station and the transporting means is preferably movable between a first position in which it can receive exchangeable rolls from or deliver exchangeable rolls to the main frame, a first second position in which it can deliver exchangeable rolls to or receive exchangeable rolls from one of the racks, and a different second position in which it can receive exchangeable rolls from or deliver exchangeable rolls to the other rack.

In accordance with one presently preferred embodiment of the invention, the framework of the transporting means comprises two parts (each of which can be assembled of two spaced-apart upright sections) and each part is provided with sets of grippers and moving means. Such parts of the framework are preferably positioned to support at least two axially aligned exchangeable rolls. Control means is preferably provided to operate the moving means of one of these sets substantially simultaneously and/or in synchronism with the moving means of the other set so that loading of exchangeable rolls onto one of the parts can take place simultaneously with unloading of exchangeable sections from the other part of the framework.

The conduits and/or conductors which connect exchangeable rolls with the control means include first portions in or on the respective exchangeable rolls and second portions in or on the main frame of the calender. The latter preferably further comprises at least one coupling for each exchangeable roll and each such coupling comprises a first component or half connected to the portions of conduits and/or conductors in or on the respective exchangeable roll and a second component or half which is separably connected to the first component, which is mounted in or on the main frame and which is connected to the second portions of the conduits and/or conductors. The calender can further comprise a device for automatically attaching the two components to or for automatically detaching the two components from one another. Such device can receive signals in response to initiation of an exchange of rolls to ensure that the first and second portions of the conduits and/or conductors are separated from one another before the respective exchangeable roll or rolls are caused to move from the first to the second positions and especially from the second positions and off the main frame.

The aforementioned signal generating sensor means for monitoring the condition of exchangeable rolls can be connected with switching means for initiating the exchange of a roll when the respective sensor means transmits or transmit signals denoting that replacement of the corresponding exchangeable roll is in order. The control means of the calender can comprise means for comparing the signals from such sensor means with predetermined reference signals and for operating the switching means to initiate the replacement of the corresponding exchangeable roll or rolls in response to predetermined deviation of signals which are generated by the sensor means from the reference signals.

The novel features which are considered as characteristic of the invention are set forth in particular in the appended claims. The improved calender itself, however, both as to its construction and its mode of operation, together with additional features and advantages thereof, will be best understood upon perusal of the following detailed description of certain specific embodiments with deference to the accompanying drawing.

BRIEF DESCRIPTION OF THE DRAWING

FIG. 3 is a front elevational view of a mobile rack for exchangeable rolls which is used in the calender of FIGS. 1 and 2;

FIG. 4 is a diagrammatic view of control means for the calender of FIGS. 1 and 2;

DESCRIPTION OF THE PREFERRED EMBODIMENTS

Figure 1:
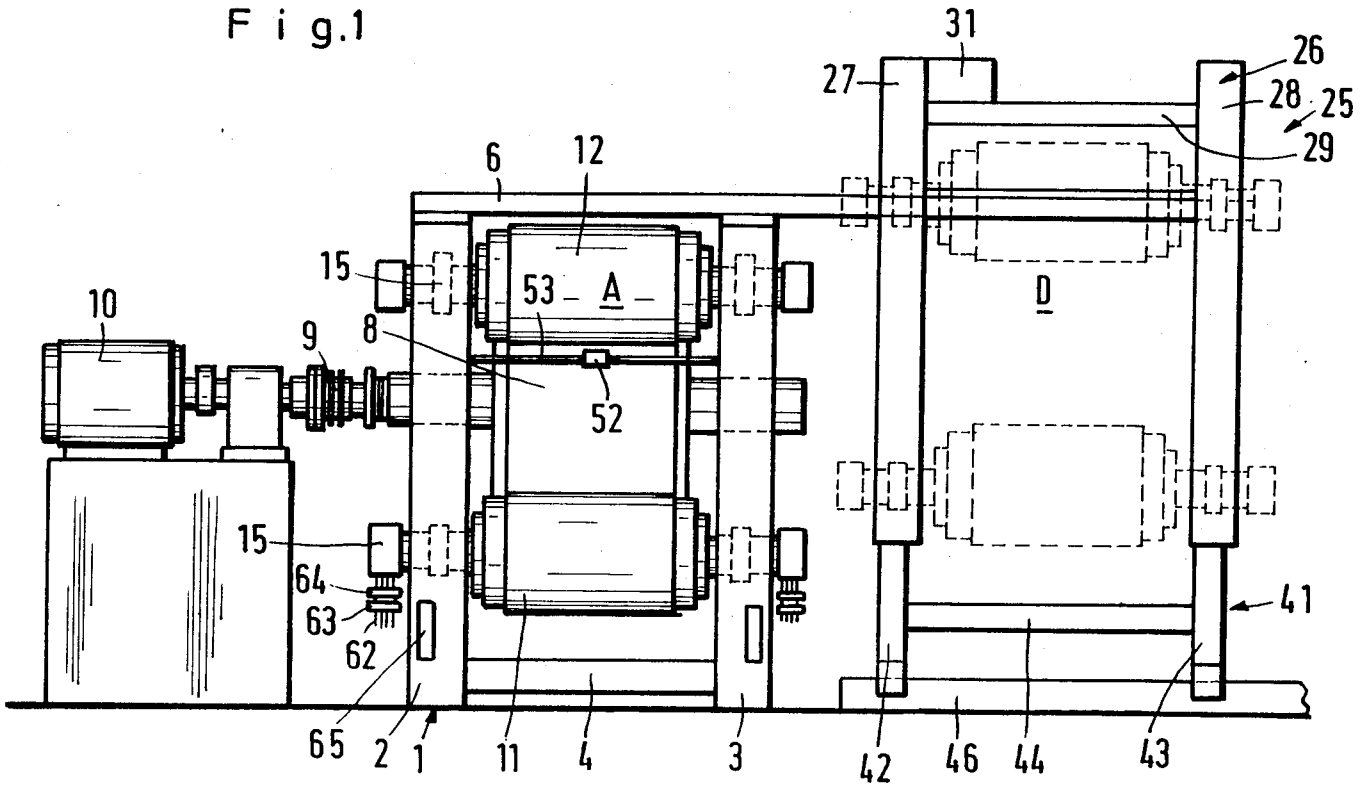
FIG. 1 is a schematic side elevational view of a calender with a single rack for exchangeable rolls which embodies one form of the invention, the transporting unit being shown in a position at one side of the main frame of the calender.
Figure 2:
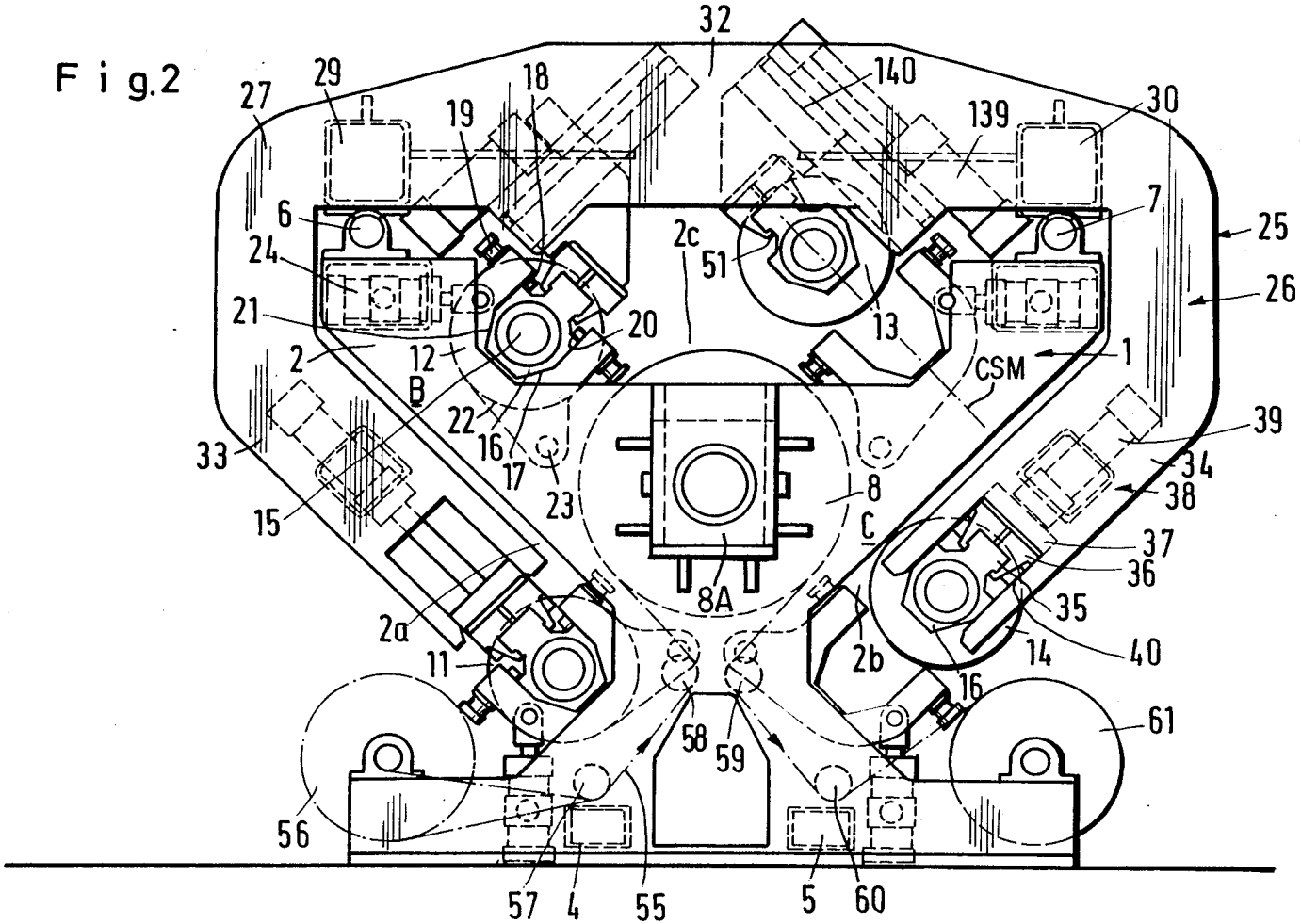
FIG. 2 is an enlarged front elevational view of the calender, the framework of the transporting unit being shown in a position it occupies when the transporting unit is in the process of receiving one or more exchangeable rolls from or of transferring one or more exchangeable rolls to the main frame of the calender.

Referring first to FIGS. 1 and 2, there is shown a calender which comprises a main frame 1 having two spaced-apart upright frame members 2, 3 whose lower portions are connected to each other by two horizontal braces 4, 5 and whose upper portions are connected to each other by elongated horizontal guide members 6, 7 in the form of rods, rails or the like. The frame 1 supports a main or primary roll 8 which forms part of an assembly of five rolls further including four exchangeable rolls 11, 12, 13 and 14. The main roll 8 is more or less permanently installed in the frame 1 and receives torque from an electric motor 10 or another suitable prime mover through the medium of a flexible coupling 9. The end portions of the main roll 8 are journalled in bearings 8A provided therefor in the frame members 2 and 3. The main roll 8 has a hard shell which is made of steel or constitutes a casting and is preferably heated from within, e.g., by a flowable heat exchange medium.

At least some of the exchangeable rolls 11–14 are preferably provided with elastomeric outer layers which can be biased against the external surface of the shell of the main roll 8 or against a running web 55 of flexible material with a selected force. All of the exchangeable rolls 11–14 are preferably constructed and assembled in a manner as disclosed in commonly owned U.S. Pats. Nos. 4,328,744, 4,394,793, 4,376,330, 4,425,489 and 4,290,353, i.e., a deformable cylindrical shell surrounds a rigid carrier whose end portions are non-rotatably mounted in the frame of the calender and which surrounds one or more rows of hydrostatic supporting elements each of which can be shifted radially of the carrier by one or more adjustable hydraulic motors to thereby alter the shape of the shell for the purpose of uniformizing or otherwise selecting the pressure upon the web or sheet of material which is caused to pass through the nip of the shell and the adjacent roll. In the following description, reference to end portions of exchangeable rolls should be interpreted as denoting the end portions of a stationary carrier for a deformable shell or the end portions of the shell, depending upon whether or not a particular exchangeable roll is constructed, assembled and operated in a manner as disclosed in the above-enumerated commonly owned United States Letters Patent.

The mounting of all four exchangeable rolls 11–14 is the same. FIGS. 1 and 2 merely show in detail the mounting of the roll 12 which, with the roll 13, is installed at a level above the axis of the main roll 8. The two end portions 15 of the roll 12 are installed in discrete bearings 16 which, in turn, are removably received in the seats 21 of two sockets 17 movably installed in the frame 1. Each of the seats 21 is open at one side to allow for introduction or withdrawal of the respective bearing 16, and each of the seats 21 has a deepmost portion bounded by two edge faces which converge in a direction away from the respective open side. The bearings 16 have complementary tapering portions which can be snugly received between the convergent edge faces of the respective sockets 17 to ensure predictable mounting of such bearings in their respective seats.

Each socket 17 carries a locking device 18 in the form of a bolt which is reciprocable into and from engagement with a shoulder 20 of the respective bearing 16. Such shoulders are provided adjacent to specially designed bosses or heads 35 of the respective bearings 16. The means for actuating the locking devices 18 (i.e., for moving such devices into and from engagement with the respective shoulders 20) comprises fluid-operated motors 19 which are mounted on the respective sockets 17 and can be operated by remote control in response to signals from a control unit 48 which is shown in FIG. 4.

Each of the sockets 17 is mounted on a discrete holder 22 here shown as a lever which is pivotable about the axis of a horizontal pin 23 in the respective frame member 2 or 3. The levers 22 form part of shifting means which further include hydraulic motors 24 mounted on the respective frame members 2, 3 and articulately connected to the respective levers 22 to pivot them to and from first positions (note the position A of the exchangeable roll 12 in FIG. 1) to second positions B (FIG. 2) or vice versa. The motors 24 can further serve as a means for biasing the respective exchangeable rolls against the main roll 8 with a variable force which is selected and adjusted by the control unit 48. This obviates the need for the provision of discrete biasing means for the exchangeable rolls 11–14. The second positions B of the exchangeable rolls 11–14 with reference to the frame 1 are fixed; this renders it possible to predictably remove the roll 11, 12, 13 and/or 14 from the corresponding sockets 17 as soon as the roll reaches the position B.

The calender of FIGS. 1 and 2 further comprises a transporting unit 25 having a framework 26 with two spaced-apart upright sections 27, 28 which are held together by braces 29 and 30. A reversible motor 31 is provided on the section 27 to move the framework 26 along the guide members 6 and 7. Each of the sections 27, 28 comprises a substantially horizontal web or bridge member 32 at a level above the frame 1 and two arms 33, 34 which extend downwardly from the respective end portions of the web 32 and flank the frame 1.

The arms 33, 34 support pairs of mobile grippers 36 for the heads 35 of the bearings 16 for the end portions 15 of the exchangeable rolls 11, 12 and 13, 14, respectively. The grippers 36 for the bearings 16 which carry the end portions 15 of the exchangeable roll 14 are shown in the lower right-hand portion of FIG. 2. They can constitute pairs of mirror symmetrical claws which are reciprocable transversely of the axis of the roll 14 by a drive 37 mounted on a support 38 which is reciprocable radially of the roll 14 by a motor 39 on the respective arm 34. The drives 37 for the pairs of grippers 36 and the reciprocating motors 39 are actuated by the control unit 48 in a predetermined sequence whenever the need arises, i.e., whenever it becomes necessary to extract the bearings 16 for the end portions 15 of the exchangeable roll 11, 12, 13 and/or 14 from the seats 21 of the respective sockets 17. Each of the reciprocating motors 39 can comprise a double-acting fluid-operated motor, preferably a hydraulic cylinder and piston unit. The same holds true for the drives 37 which are used to move the grippers 36 relative to each other, i.e., into and from engagement with the respective bosses or heads 35. The arms 33 and 34 include portions 40 which constitute guides or ways for the grippers 36 when the respective supports 38 are moved by the associated reciprocating motors 39. The guides or ways 40 define for the grippers 36 paths which are parallel to the axes of the respective reciprocating motors 39. In order to achieve savings in space, the axes of the reciprocating motors 139 for the grippers which can engage the heads of the bearings 16 for the two upper exchangeable rolls 11 and 13 are parallel to (rather than located in) the planes including the axes of the rolls 11 and 13. The corresponding guides or ways are shown at 140 in the upper part of FIG. 2.

The control unit 48 causes the drives 37 to move the grippers 36 toward and into engagement with the heads 35 of the respective bearings 16 when the corresponding exchangeable rolls assume the positions B. The control unit 48 then causes the corresponding reciprocating motors 39 and/or 139 to extract the bearings 16 from their sockets 17 through the medium of the supports 38, drives 37 on such supports and the grippers 36 so that the respective exchangeable roll or rolls are transferred from the main frame 1 into the framework 26 of the transporting unit 25. The reference character C denotes in FIG. 2 the position of the exchangeable roll 14 subsequent to extraction of its bearings 16 from the corresponding sockets 17. The reference character D denotes in FIG. 1 the position of the roll 14 after the framework 26 is moved along the guide members 6, 7 (in response to starting of the reversible motor 31) in order to move the extracted exchangeable roll or rolls in the axial direction of the main roll 8 and in front of or behind the main frame 1. It goes without saying that the locking bolts 18 must be retracted by the respective actuating motors 19 (to become disengaged from the shoulders 20 of the respective bearings 16) prior to movement of the respective rolls 11–14 from the positions A to the positions B, and that the drives 37 remain active to maintain the grippers 36 in engagement with the heads 35 of the respective bearings 16 during movement of the respective exchangeable rolls from the positions B to the positions C, from the positions C to the positions D or in the opposite direction.

The frame members 2 and 3 are formed with apertures *2a, 2b* and *2c* in the form of cutouts. The apertures *2a, 2b* are disposed at a level below the bearings 8A for the main roll 8, and the aperture *2c* is disposed at a level above such bearings. These apertures allow for unobstructed transport of the exchangeable rolls 11–14 between the positions C and D.

The central symmetry planes (see the plane CSM in FIG. 2) of the seats 21 in the sockets 17 make relatively small acute angles with the planes which are tangential to the main roll 8 and the respective exchangeable rolls in the regions where the roll 8 and the rolls 11–14 define the respective nips. The acute angles are preferably smaller than 31°. Each of the planes CSM halves the open side of the respective seat 21. The open sides of the seats 21 are inclined upwardly, i.e., the grippers 36 pull the heads 35 of the respective bearings 16 from lower levels to higher levels during movement of the corresponding exchangeable rolls from the positions B to the positions C. When the rolls 11–14 are moved to the positions B (i.e., when they are pivoted about the axes of the respective fulcra 23 away from contact with the peripheral surface of the main roll 8) the respective planes CSM are substantially parallel to the aforementioned tangential planes; this facilitates the extraction of bearings 16 from their sockets 17 and their reinsertion into such sockets, i.e., the movements of exchangeable rolls 11–14 from the positions B to the positions C or vice versa. The feature that the open sides of the seats 21 are inclined upwardly is desirable and advantageous because this ensures that the bearings 16 tend to remain properly seated in their respective sockets 17 irrespective of the weight of the corresponding exchangeable rolls. This holds true for the positions A as well as for the positions B of the rolls 11–14. If the shifting motors 24 are actuated in response to signals from the control unit 48 to urge the respective levers 22 and sockets 17 downwardly, the entire forces which are generated by the motors 24 are transmitted to the bearings 16 and, through the medium of the respective end portions 15, to the corresponding exchangeable rolls 11–14.

The calender further comprises a rack 41 which has a front wall 42 and a rear wall 43 as well as braces 44 which connect the walls 42, 43 to each other. The configuration of the wall 42 can be seen in FIG. 3; the wall 43 is preferably identical with the wall 42. The rack 41 serves for temporary storage of exchangeable rolls 11–14 and is formed with four pairs of sockets 45 (hereinafter called receiving means to distinguish from the sockets 17 on the frame 1) which are similar to the sockets 17. Thus, the seats 45A of the receiving means 45 are also configurated to snugly receive the bearings 16 on the end portions 15 of the corresponding exchangeable rolls. The receiving means 45 further carry locking bolts 118 which are analogous to or identical with the locking bolts 18 and can be actuated by the reciprocable elements of fluid-operated motors 119. The positions of the receiving means 45 with reference to the corresponding walls 42, 43 correspond to the positions of the sockets 17 relative to the frame members 2, 3 when the corresponding exchangeable rolls 11–14 assume the positions B. This enables the grippers 36 to introduce the bearings 16 into the respective receiving means 45, i.e., to move the exchangeable rolls (in the positions D) from the positions C to the positions B, i.e., into the receiving means 45 of the rack 41 rather than into the sockets 17 of the levers 22 on the frame members 2 and 3. The walls 42 and 43 are movable along stationary guide rails 46, 47 which are mounted on the floor or at a level close to the floor so that the removed exchangeable roll or rolls can be delivered into a repair shop or to temporary storage. For example, the rack 41 can be used as a means for conveying one or more freshly removed exchangeable rolls into a special department of the plant using one or more calenders where the exchangeable roll or rolls are cleaned, refinished . (e.g., turned to size), ground, polished, washed and/or otherwise treated prior to transport into storage or back to the same or to a different calender. In order to reduce the intervals of idleness, a second rack 41 with one or more refinished or new exchangeable rolls can be moved to the position occupied in FIG. 1 by the rack 41 so as to enable the transporting unit 25 to accept one or more fresh or freshly finished exchangeable rolls (in the positions D) and deliver such rolls first to the positions C and thereupon to the positions B whence the levers 22 move the rolls to the positions A, i.e., into contact with the adjacent portions of the peripheral surface of the main roll 8. The manner in which the grippers 36 can withdraw fresh or refinished rolls from the receiving means 45 of a rack 41 is the same as the manner of removing damaged or worn exchangeable rolls from the sockets 17.

The extent to which the operation of the calender is automated can be selected practically at will. For example, the transporting unit 25 can constitute a manipulating robot whose grippers 36 perform the functions of effectors and whose drives 37 and reciprocating motors 39 perform the functions of manipulators. The construction and mode of operation or regulation of manipulating robots are known in the art. Reference may be had, for example, to pages 790–793 and 839–843 of the German-language VDI-Zeitschrift No. 123 (1981). The means for regulating the operations of various motors and the like includes the aforementioned control unit 48 with a processing system. The unit 48 includes a first component 49 which regulates the normal operation of the calender in a manner not forming part of the present invention. For example, the inputs E of the component 49 can receive signals denoting the characteristics of the web 55. The inputs F transmit reference signals denoting desirable parameters which are used to regulate the operation of the calender, and the inputs R transmit signals denoting the monitored parameters in the calender. The signals which are received at the inputs E, F and R are compared and/or otherwise evaluated and the processed signals are used to regulate the supply of energy (e.g., the pressure $P_1$ of the fluid flowing into the cylinder chambers of the motors 24 which urge the exchangeable rolls 11–14 against the peripheral surface of the main roll 8 or against the running web 55; the pressure $P_2$ of fluid medium which is admitted to the adjustable motors in the deformable shells of one or more exchangeable rolls to change or select and maintain the positions of the corresponding hydrostatic supporting elements; and/or the temperature T of the main roll 8).

A second component 50 of the control unit 48 is designed to effect partially or fully automated removal and introduction of exchangeable rolls. The inputs P transmit to the component 50 a program pertaining to the operations which are to be performed in connection with the removal and insertion of exchangeable rolls. The positions, the speeds, the mutual positions and/or other characteristics of mobile parts of the means for effecting the removal and introduction of exchangeable rolls are monitored by suitable sensors which transmit appropriate signals to the component 50. FIG. 2 shows, by way of example, a sensor 51 which monitors the positions of the grippers 36 for the bearings 16 of the roll 13 and which is operatively connected with the component 50 of the control unit 48. The signals from the sensors are transmitted to the inputss and are compared with signals which are transmitted to the inputs F, and the resulting signals are used to regulate the operation of the roll removing and inserting means. For example, the output or outputs $B_1$ of the component 50 can transmit signals which are used to control the operation of the shifting motors 24, the output or outputs $B_2$ can transmit signals for operation of the actuating motors 19, the output or outputs $B_3$ can transmit signals for operation of the drives 37 for the grippers 36, the output or outputs $B_4$ can be used for transmission of signals to the reciprocating motors 39, and the output or outputs $B_5$ can be used to transmit appropriate signals to the reversible motor 31 of the transporting unit 25.

If the transporting unit 25 constitutes a robot, the improved calender is operated as follows:

A signal from the output $B_1$ of the component 50 of the control unit 48 causes the selected shifting motors 24 to pivot the corresponding levers 22 in order to move the respective exchangeable roll 11, 12, 13 or 14 from the position A to the position B. A signal from the output $B_4$ then causes the motors 39 to move the grippers 36 (such grippers are then held in their open or spaced-apart positions) toward the respective heads 35. A signal from the output $B_3$ thereupon initiates closing of the grippers 36 under the action of the drives 37 so that the grippers engage the respective heads 35 and thus couple the bearings 16 to the transporting unit 25. The output $B_2$ then transmits a signal to disengage the locking bolts 18 through the medium of the corresponding actuating motors 19 so that the bearings 16 can be extracted from the respective seats 21; such extraction takes place in response to a signal from the output $B_4$ which causes the reciprocating motors 39 to effect extraction of the bearings 16 from their sockets 17, i.e., the selected exchangeable roll 11, 12, 13 or 14 is moved from the position B to the position C. The output $B_5$ then transmits a signal to the reversible motor 31 which causes the transporting unit 25 to move along the guide members 6, 7 and to advance the selected exchangeable roll from the position C to the position D. The output $B_4$ then transmits a signal to the reciprocating motors 39 which cause the grippers 36 to deliver the exchangeable roll into the receiving means 45 of the rack 41. The output $B_3$ then transmits a signal which causes the drives 37 to disengage the grippers 36 from the heads 35 of the respective roll, and the output $B_4$ thereupon transmits a signal to the motors 39 which retract the opened grippers 36 so that the transporting unit 25 is disengaged from the roll 11, 12, 13 or 14 which then rests in the corresponding pair of receiving means 45 of the rack 41 so that the latter can be caused to advance along its guide rails 46, 47. The transporting unit 25 is then ready to receive a new or a repaired exchangeable roll for delivery to the main frame 1 or to return to a position in which it can receive another roll from the frame 1.

FIG. 1 shows a sensor 52 which is movable back and forth along a track 53 in parallelism with the axis of the exchangeable roll 12. The purpose of the sensor 52 is to monitor the quality of the peripheral surface of the roll 12. For example, the sensor 52 can monitor the temperature of different longitudinally aligned portions of the peripheral surface of the roll 12 and its signals can furnish indications as to the temperature profile of the roll. Alternatively, or in addition to a temperature-monitoring function, the sensor 52 can also constitute an optical device which determines the quality of the peripheral surface of the roll 12 by ascertaining the extent of diffusion of one or more beams of radiation which is caused to impinge upon the exterior of the roll 12. The corresponding signals are transmitted to the input M of the component 50 of the control unit 48 of FIG. 4 and are compared with reference signals which are applied to the input G of the component 50. A switching circuit 54 of the component 50 automatically initiates the exchange of the roll 12 when the evaluation of signals which are transmitted to the input M (e.g., a comparison of such signals with the reference signal or signals transmitted to the input M) reveals that the roll 12 necessitates inspection, replacement, repair or refinishing, i.e., when the difference between the characteristics of the signals which are applied to the inputs G and M is outside of a range of acceptable differences or when the intensity of signals which are transmitted to the input M rises above or drops below a preselected threshold value.

It goes without saying that the improved calender is equipped with additional sensors 52 which are caused to move along the rolls 11, 13 and 14 and serve to initiate replacement of the corresponding rolls when the quality of such rolls does not meet certain minimum standards which are required for adequate treatment of the web 55.

FIG. 2 shows that the means (including the levers 22, the sockets 17, the motors 24 and the transporting unit 25) for effecting removal or insertion of exchangeable rolls does not interfere with the normal operation of the calender, i.e., with the treatment of the web 55. This is due to the fact that all parts which are needed to effect the introduction of exchangeable rolls into or the removal of such rolls from the main frame 1 are located outside of the path of advancement of the web 55 from a supply reel 56 to a takeup reel 61 on the frame 1. The latter further supports guide rollers 57, 58, 59 and 60 which direct successive increments of the running web 55 toward the locus of initial contact with the peripheral surface of the main roll 8 (upstream of the nip between the rolls 8 and 11) and from the locus of disengagement of the treated web from the peripheral surface of the roll 8 (downstream of the nip of the rolls 8 and 14) to the takeup roll 61. Successive increments of the running web 55 advance through the nips between the roll 8 on the one hand and the rolls 11, 12, 13 and 14 on the other hand. However, it is also possible to reduce the number of active exchangeable rolls if the nature of treatment of a running web is such that it suffices to guide the web through fewer than four nips. This renders it possible to replace a damaged or worn exchangeable roll (11, 12, 13 or 14) while the calender is in actual use. Alternatively, one of the exchangeable rolls 11, 12, 13 and 14 is simply moved from the position A to the position B and dwells in the position B if the web 55 can be adequately treated as a result of advancement through fewer than four nips.

If an exchangeable roll confines one or more rows of hydrostatic supporting elements and at least one fluid-operated adjustable motor for each supporting element so that it must be connected to one or more energy sources and/or one or more signal generating or transmitting units, the control unit 48 can further effect automatic attachment of such exchangeable roll to and its detachment from signal receiving and signal or energy transmitting conduits and/or conductors 62. This is shown schematically in FIG. 1 wherein the left-hand end portion 15 of the exchangeable roll 11 carries one half 64 of a coupling the other half 63 of which is mounted in the frame 1. The halves 63, 64 of such coupling can be automatically separated from or secured to each other by a suitable attaching-detaching device 65 which is mounted in the frame 1 and receives signals from the person or persons in charge but preferably directly from the control unit 48. If the number of conductors and/or conduits 62 leading into and/or from an exchangeable roll is substantial, at least one end portion of such roll can be provided with the corresponding halves of two or more couplings or at least one coupling can be provided at each end of the corresponding exchangeable roll (see FIG. 5). The device 65 is caused to disengage the halves 63, 64 of the coupling from each other before the respective roll 11 is lifted out of its sockets 17. The exact nature of the device 65 forms no part of the present invention; it can comprise an electromagnetic arrangement with one or more electromagnets which are energizable to move the half coupling 63 away from the half coupling 64 and one or more electromagnets which are energizable to move the half coupling 63 into engagement with the adjacent half coupling 64.

The control unit 48 of FIG. 4 may be of the type known as 584 which is manufactured and distributed by Modicon or of the type known as LSI 11/23 which is manufactured and sold by Digital Equipment.

An important advantage of the improved calender is that the bearings 16 are more or less permanently mounted on the end portions 15 of the respective exchangeable rolls 11–14 so that they share the movements of the respective exchangeable rolls between the positions A, B, C and D. The provision of specially designed heads 35 ensures predictable and reproducible engagement of the grippers 36 with the respective bearings 16 and predictable extraction of such bearings from their sockets 17 or receiving means 45 as well as predictable reinsertion of such bearings into the corresponding sockets 17 and/or receiving means 45. Moreover, the heads 35 cooperate with the associated grippers 36 to ensure reliable retention of the respective exchangeable rolls during transport from the positions B to the positions C, from the positions C to the positions D, from the positions D to the positions C and/or from the positions C to the positions B. The grippers 36 need not contact the peripheral surfaces of the exchangeable rolls which, in turn, ensures, that the quality of the peripheral surfaces of exchangeable rolls is affected only by the main roll, by the web 55 and/or by signals from the control unit 48. The provision of discrete motor means (24, 37, 39, 31) allows for desirable complete or partial automation of the extraction of the bearings 16 of exchangeable rolls 11–14 from their pairs of sockets 17 and/or reintroduction of such bearings into the respective pairs of sockets. The same holds true for the extraction of bearings 16 from and for reintroduction of such bearings into the receiving means 45 of the rack 41. The control unit 48 ensures that the various motors are operated in a predetermined sequence, e.g., that the locking bolts 18 are moved to inoperative positions prior to movement of the respective exchangeable rolls from the positions B to the positions C, that the grippers 36 reliably hold the adjacent heads 35 before the corresponding moving means 38–39 are caused to move the grippers 36 in directions to extract the bearings 16 from the respective sockets 17 or from the respective receiving means 45, and so forth. The utilization of a transporting unit 25 which constitutes a robot and whose grippers 36 constitute effectors contributes to further automation of the replacement of exchangeable rolls and ensures that such replacement can be completed within shortest possible intervals of time. Moreover, the various movements are carried out with a very high degree of accuracy.

The features that the exchangerable rolls 11–14 are provided with pairs of bearings 16 which remain attached to the respective end portions 15 in each and every position of the respective exchangeable roll renders it possible to provide each of the exchangeable rolls with an elastomeric outer layer because such layers are not touched at all during exchange of the respective rolls. Moreover, the mounting of bearings 16 directly on the end portions of the exchangeable rolls renders it possible to distribute these rolls in such a way that they can be moved to and from the positions A, B, C and/or D without necessitating removal of the web 55 from its path which is not intersected by the paths of movement of exchangeable rolls relative to the main roll 8.

The provision of holders in the form of pivotable levers 22 which cooperate with the respective motors 24 to effect movements of exchangeable rolls 11–14 between the positions A and B contributes to simplicity and compactness of the improved calender. The distances between the positions A and B are relatively small so that there is no need to provide a shifting mechanism which is designed to reciprocate the sockets 17 with reference to the main frame 1. In addition, the provision of shifting means 22, 24 which employ pivotable levers contributes to lower cost of the calender because such shifting means are less expensive than means for reciprocating the sockets in order to move the respective exchangeable rolls between the positions A and B.

The aforediscussed inclination of the central symmetry planes CSM of the seats 21 exhibits the advantage that the sockets 17 can readily transmit forces from the motors 24 to the end portions 15 of the exchangeable rolls when the exchangeable rolls dwell in the positions A and the calender is in actual use as well as that the grippers 36 can readily extract the bearings 16 from their sockets 17 when the motors 24 are caused to effect movements of the exchangeable rolls 11–14 to the positions B.

While it is possible to provide a discrete transporting unit for each exchangeable roll or a discrete transporting unit for each pair of exchangeable rolls, the provision of a common transporting unit 25 for all of the exchangeable rolls contributes significantly to the compactness and lower cost of the calender. The aforedescribed configuration of the sections 27, 28 of the framework 26 renders it possible to provide all of the grippers 36, drives 37, supports 38 and motors 39 on the two sections and to distribute these parts in such a way that the grippers 36 can reach the heads 35 of bearings 16 on all four exchangeable rolls 11–14 at the same time as well as that they can deposit two, three or all four exchangeable rolls in the receiving means 45 of the rack 41. The provision of apertures **2*a*, 2*b* and 2*c* in the frame member 2 and/or 3 of the main frame 1** also contributes to simplicity of the roll replacing operation. Such apertures do not unduly weaken the respective frame member(s) because the distance between the positions A and B of the exchangeable rolls is relatively small.

The mounting of the framework 26 of the transporting unit 25 directly on the (rails 6, 7 of the) main frame 1 contributes to compactness of the calender. Moreover, the framework 26 is or can constitute a relatively lightweight skeleton frame which can be readily supported by the main frame 1 of the calender.

The distribution or mutual positioning of receiving means 45 on the walls 42, 43 of the rack 41 in the same way as the distribution of sockets 17 on the main frame 1 (when the rolls 11–14 assume the positions B) brings about the important advantage that the moving means 38, 39 can be used to effect the extraction or insertion of bearings 16 into and from the sockets 17 as well as into and from the receiving means 45. This simplifies the construction and reduces the bulk of the calender. The rack 41 can be used for temporary or even longer-lasting storage of refurbished exchangeable rolls or fresh rolls as well as for temporary or longer-lasting storage of defective rolls. Moreover, the defective rolls can remain on the rack 41 during treatment of their external surfaces and/or during other types of treatment. Treatment of defective (e.g., contaminated or worn) exchangeable rolls while such rolls are supported by the rack 41 is possible and convenient because the bearings 16 remain attached to the end portions 15 of the respective rolls so that the rolls can be rotated relative to their bearings while the bearings are confined in the respective receiving means 45 of the rack 41. Rotation of rolls is desirable or indispensable during cleaning, turning, grinding, polishing and/or certain other treatments.

Figure 5:
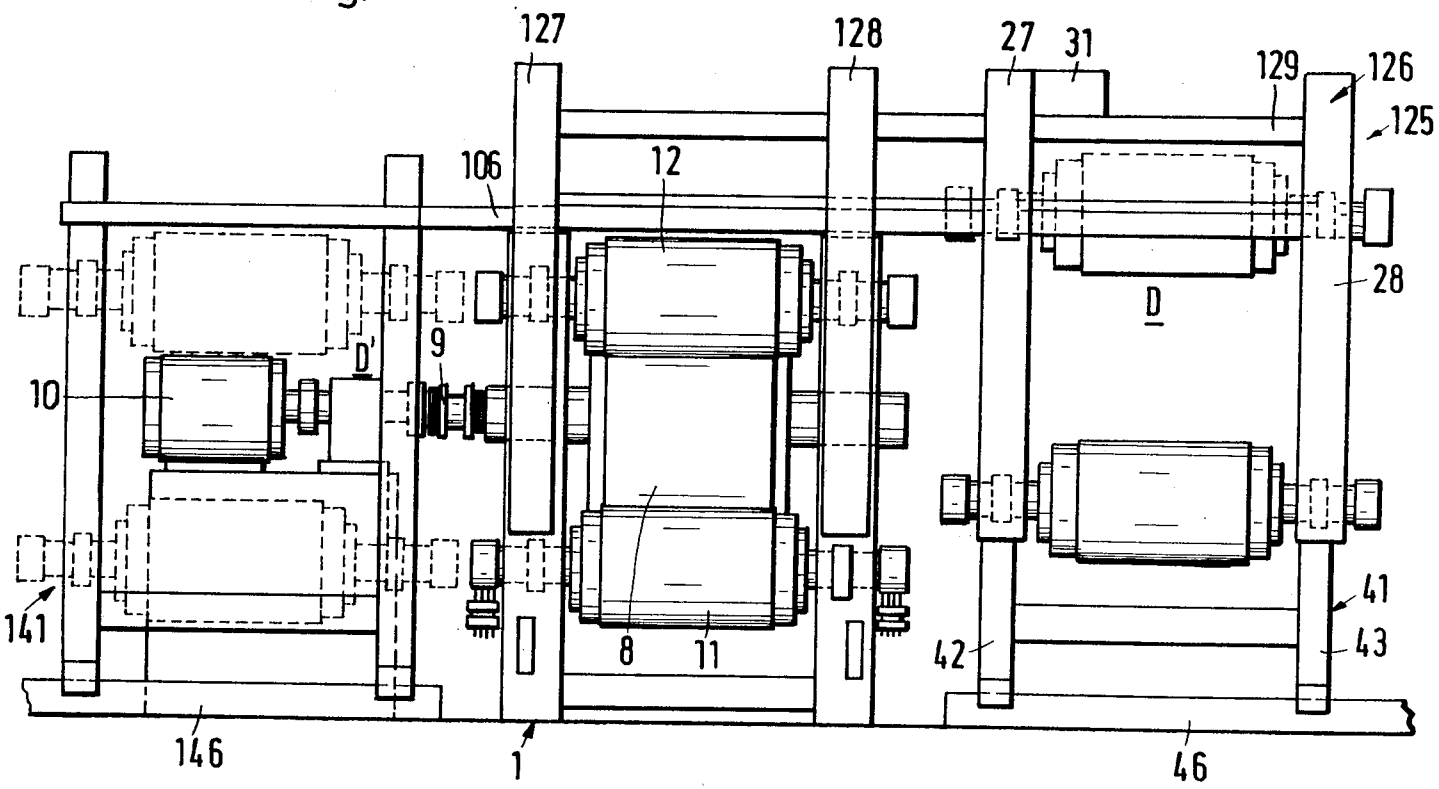
FIG. 5 is a side elevational view of a modified calender having a different transporting unit and two mobile racks for exchangeable rolls.

FIG. 5 shows a modified calender which includes all parts of the calender of FIGS. 1–3 (such parts are denoted by the same reference characters as those used in FIGS. 1–3). In addition, the transporting unit 125 (which includes a framework 126 with sections 27, 28 corresponding to the framework 26 and sections 27, 28 of FIGS. 1 and 2) further comprises two additional sections or uprights 127, 128. All of the sections 27, 28, 127, 128 are or can be rigidly connected to each other by a single set of braces 129 or other suitable connecting means. The guide rails (only the rail 106 can be seen in FIG. 5) are longer than the rails 6 and 7. The sections 27, 28 are or can be identical with the sections 127 and 128, respectively. Thus, the sections 127, 128 also support a pair of grippers 36 (not specifically shown) for each bearing 16 of an exchangeable roll, a drive 37 for each pair of grippers, a support 38 for each drive 37 and a reciprocating motor 39 for each support 38. This enables the transporting unit 125 to carry at least one pair of coaxial exchangeable rolls, one in the part including the sections 27, 28 and the other in the part including the sections 127, 128.

Figure 6:
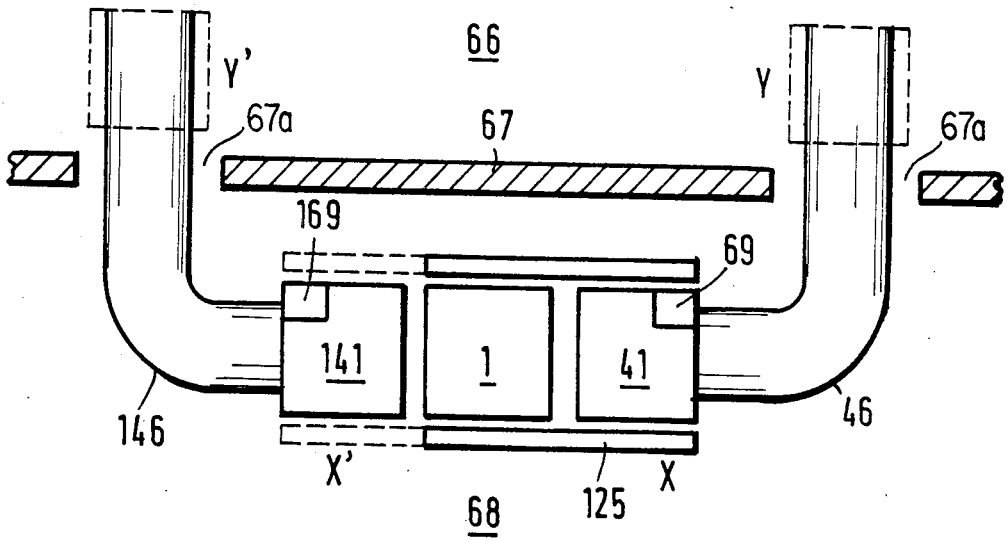
FIG. 6 is a smaller scale plan view of the calender which is shown in FIG. 5.

The calender of FIG. 5 further comprises the rack 41 as well as an additional rack 141. The racks 41 and 141 are disposed at the opposite sides of the frame 1, i.e., at the opposite axial ends of the main roll 8. The rack 141 is preferably identical with the rack 41 and is mounted on guide rails 146. As can be seen in FIG. 6, the guide rails 46 and 146 define arcuate paths for the respective racks 41, 141 so that the rack 41 can be transported or conveyed from the solid-line position X to the broken-line position Y or vice versa, and the rack 141 can be conveyed between the solid-line position X′ and the broken-line position Y′. The paths for the racks 41 and 141 extend through suitably dimensioned openings **67*a* in a partition 67 which separates the space or station 68 accommodating the calender frame 1 from a space or station 66** where the exchangeable rolls can be treated (e.g., washed, otherwise cleaned, refinished and/or inspected).

The calender which is shown in FIGS. 5 and 6 allows for a surprisingly simple and time-saving exchange of rolls. Thus, when a sensor 52 (not specifically shown in FIGS. 5 and 6) or an analogous sensor transmits a signal or a series of signals denoting that the respective roll must be removed from the main frame 1 and transported to the station 66, such signal automatically entails a movement of the rack 141 (which carries a set of refurbished or fresh exchangeable rolls) from the position Y′ to the position X′ and a movement of the rack 41 (which is empty) from the position Y to the position X. The reversible drives for the racks 41 and 141 are respectively shown at 69 and 169. The roll removing parts on the sections 27, 28 of the transporting unit 125 then engage and remove from the frame one, two, three or four exchangeable rolls for delivery to the corresponding pair or pairs of receiving means 45 in the rack 41 which, at such time, dwells in the position X. At the same time, the roll delivering parts on the sections 127, 128 of the transporting unit 125 remove one, two, three or four refinished or new exchangeable rolls from the rack 141. In the next step, the transporting unit 125 is shifted in a direction to the right, as viewed in FIGS. 5 and 6 (namely from the broken-line to the solid-line position of FIG. 6), so that the removed defective roll or rolls can be deposited on the rack 41 and the substitute roll or rolls can be deposited on the frame 1. The racks 41 and 141 are thereupon returned to the station 66 where they respectively assume the broken-line positions Y and Y′. If the nature of treatment of webs in the calender of FIGS. 5 and 6 is such that the webs must be treated by the maximum number of rolls, the calender is idle only during the surprisingly short interval of time which is required for replacement of one or more defective exchangeable rolls with the same number of refinished or new exchangeable rolls. As mentioned above, the calender can remain in operation if a web which is being transported from the supply reel 56 to the takeup reel 61 need not be treated in the maximum number of nips, e.g., if the treatment merely necessitates the utilization of the main roll 8 and three exchangeable rolls. Under such circumstances, a defective roll can be lifted off the main roll 8 and a spare roll is simultaneously shifted from the position B to the position A, whereupon the transporting unit 125 replaces the lifted defective roll with a fresh or refinished roll while the calender continues to treat the web. Still further, it is possible to avoid any interruptions in operation of the calender if the nature of treatment or the nature of webs is such that short-lasting treatment with fewer than the maximum number of rolls does not necessitate discarding of the corresponding portions or lengths of the web.

It is also possible to move the rack 41 and/or 141 by means of a crane, for example, if there is no room for the laying of guide rails 46 and/or 146 in a manner as shown in FIG. 6. The provision of a partition 67 or other suitable separating means is desirable because this reduces the likelihood of contamination of rolls in the main frame 1 (i.e., at the station 68) by dust and/or other foreign matter which develops at the station 66. The provision of automatically operable reversible drives 69, 169 for the racks 41 and 141 contributes to further automation of the roll exchanging operation in that the racks 41 and 141 are automatically advanced from the positions Y, Y′ to the positions X, X′ in response to initiation of a roll-exchanging operation and back to the positions Y, Y′ when the exchanging operation is completed. This greatly reduces the intervals of idleness of the calender if the nature of the required treatment is such that all of the exchangeable rolls must cooperate with the main roll. The interval of idleness is then reduced to that which is required for actual transfer of damaged rolls from the positions A to the positions C and for immediately following transfer of fresh rolls from the positions C to the positions A.

The intervals of idleness of the calender are reduced still further if the transporting unit 125 is designed to have two parts each of which can carry a set of exchangeable rolls. Thus, the part including the sections 27, 28 carries one group of exchangeable rolls and the part including the sections 127, 128 carries another group of exchangeable rolls. The exchangeable rolls in one of these parts of the framework 126 are in axial alignment with the exchangeable rolls in the other part. Each of the two parts is provided with its own grippers 36, drives 37, supports 38 and motors 39 so that the exchangeable rolls in the part including the sections 27, 28 can be manipulated independently of the exchangeable rolls in the part including the sections 127, 128. The control unit of such calender is preferably designed to operate the grippers and other movable elements in one part simultaneously or in synchronism with the corresponding movable elements in the other part of the transporting unit 125. This reduces the complexity, sensitivity and cost of the control unit.

Figure 7:
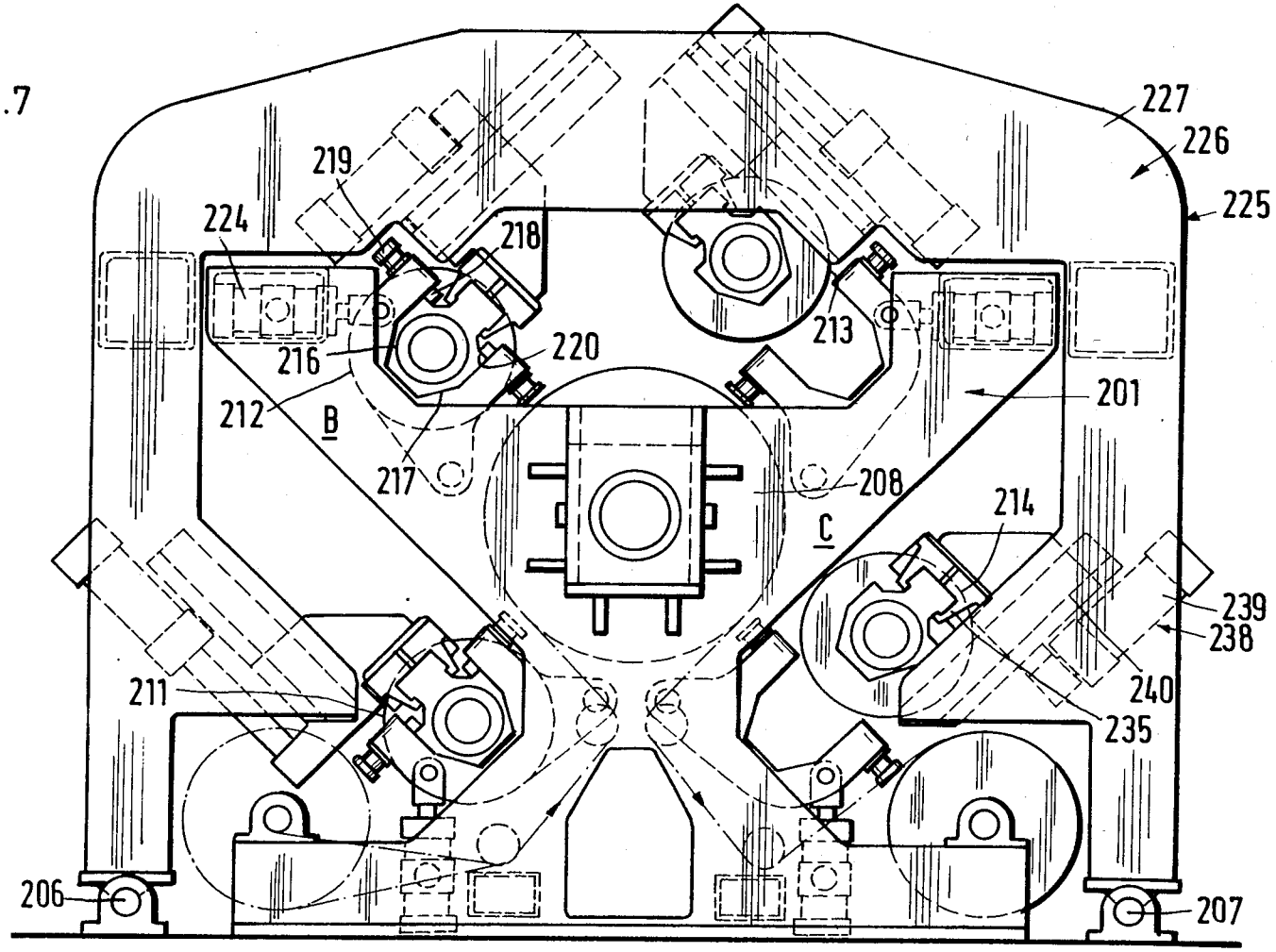
FIG. 7 is a front elevational view of a third calender with a transporting unit whose framework has two gantry-shaped sections.

FIG. 7 shows a third calender wherein all such parts which are identical with or clearly analogous to the corresponding parts of the calender of FIGS. 1 to 4 are denoted by similar reference characters plus 200. The two left-hand exchangeable rolls 211, 212 are shown in the positions B (i.e., still attached to the main frame 201 of the calender) and the two right-hand exchangeable rolls 213, 214 are shown in the positions C (supported by the framework of the transporting unit 225). The main difference between the calenders of FIGS. 1–4 and FIG. 7 is that the sections (only the section 227 shown) of the framework 226 extend downwardly all the way to the floor and are reciprocable along floor-mounted guide rails 206, 207. In other words, each of the two sections of the framework 226 resembles a gantry whose web or bridge is disposed at a level above the frame and whose flanges or arms extend downwardly all the way to and can travel along the floor-mounted guide means 206, 207. In order to reduce the bulk of the arms of the section 227 and of the other section of the framework 226, the ways or tracks for the grippers which engage the bearings 216 of the two lower exchangeable rolls 211, 214 are mounted in the same way as the upper ways, i.e., in a manner as described in connection with the reciprocating motors 139 and ways 140 of FIG. 2.

The floor-mounted framework 226 can be used with advantage in calenders which utilize bulky and heavy rolls.

The heads 35 or 235 of the bearings 16 or 216 need not be oriented in a manner as shown in FIGS. 2 and 7. For example, they can extend from the major portions of the respective bearings 16 or 216 at right angles to the illustrated positions.

It is further clear that the improved calender can also employ a roll assembly with rolls which are disposed one above the other, for example, in a manner as shown in commonly owned U.S. Pat. No. 4,347,784. The grippers for the bearings of superimposed rolls are preferably designed to move the respective rolls along horizontal or substantially horizontal paths. Removal of selected rolls is preceded by separation of the selected rolls from the neighboring roll or rolls, as considered at right angles to the axes of the rolls.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A calender, comprising a frame; at least one interchangeable roll in said frame, said roll having first and second end portions; bearings provided on said end portions; sockets for said bearings in said frame, each of said sockets having an open side permitting insertion and withdrawal of the respective bearing; locking means actuatable to releasably hold the bearings in the respective sockets; grippers movable into and from engagement with said bearings, said bearings including heads which are engageable by the respective grippers and said bearings further having shoulders adjacent to the respective heads, said locking means being mounted on the respective sockets and being actuatable to move into and out of engagement with the shoulders of the corresponding bearing; and means for moving said grippers with reference to said frame so as to move said bearings into and out of the respective sockets.

2. The calender of claim 1, further comprising actuating means for moving said locking means between operative and inoperative positions in which said bearings are respectively held in and are removable from or insertable into the respective sockets.

3. The calender of claim 1, further comprising drive means for moving said grippers into and from engagement with the respective heads.

4. The calender of claim 3, wherein said drive means are provided on said moving means.

5. The calender of claim 4, wherein said moving means comprises a support for each of said drive means and means for reciprocating said supports along predetermined paths.

6. The calender of claim 1, further comprising control means for effecting the actuation of said locking means and the operation of said moving means in a predetermined sequence.

7. The calender of claim 1, wherein said grippers constitute the effectors of a robot and further comprising signal generating sensor means for monitoring the movements of said grippers.

8. The calender of claim 1, wherein said sockets include seats which taper in directions away from the respective open sides and said bearings have complementary portions which are snugly receivable in the respective seats.

9. A calender, comprising a frame; a roll assembly including a main roll in said frame and at least one exchangeable roll having first and second end portions; means for shifting said exchangeable roll in parallelism with said main roll between a first position of engagement with and a second position remote from said main roll; bearings provided on the end portions of said exchangeable roll; sockets removably receiving said bearings, said sockets being mounted in said shifting means so that they share the movements of said exchangeable roll between said first and second positions, said shifting means comprising a holder for each of said sockets and motor means for moving said holders with reference to said main roll and said frame, each of said holders comprising a lever which is pivotable in said frame about a fixed axis; grippers movable into and from engagement with said bearings, said gippers being engageable with respective bearings in the second position of the exchangeable roll; and means for moving said grippers with reference to said frame so as to move said bearings into and out of respective sockets.

10. The calender of claim 9, wherein said motor means comprises at least one fluid-operated motor which is arranged to urge said exchangeable roll against said main roll with a variable force

11. The calender of claim 9, wherein said roll assembly comprises four parallel exchangeable rolls each of which defines with said main roll an elongated nip in the first position thereof, and further comprising means for jointly transporting said exchangeable rolls with reference to said main roll subsequent to shifting of such exchangeable rolls to their second positions.

12. The calender of claim 9, wherein said roll assembly comprises a plurality of exchangeable rolls and further comprising means for jointly transporting said exchangeable rolls with reference to said main roll subsequent to shifting of such exchangeable rolls to their second positions.

13. A calender, comprising a frame; a roll assembly including a main roll in said frame and at least one exchangeable roll having first and second end portions; means for shifting said exchangeable roll in parallelism with said main roll between a first position of engagement with and a second position remote from said main roll, said rolls defining an elongated nip in the first position of said exchangeable roll; bearings provided on the end portions of said exchangeable roll; sockets removably receiving said bearings; grippers movable into and from engagement with said bearings; and means for moving said grippers with reference to said frame so as to move said bearings into and out of the respective sockets, each of said sockets having a seat with an open side through which the respective bearing is insertable into and withdrawable from its seat, said seats having a common symmetry Plane which halves said open sides and makes an angle of less than 31° with a second plane which extends through said nip and is tangential to said rolls in the first position of said exchangeable roll.

14. The calender of claim 13, wherein said grippers are arranged to move the respective bearings from a lower level to a higher level during extraction of such bearings from the respective sockets.

15. A calender, comprising a frame; a roll assembly including a main roll in said frame and a plurality of exchangeable rolls each having first and second end portions; means for shifting said exchangeable rolls in parallelism with said main roll between first positions of engagement with and second positions remote from said main roll; bearings provided on the end portions of said exchangeable rolls; sockets removably receiving said bearings; grippers movable into and from engagement with said bearings; means for moving said grippers with reference to said frame so as to move said bearings into and out of the respective sockets; and means for jointly transporting said exchangeable rolls with reference to said main roll subsequent to shifting of such exchangeable rolls to their second positions, said transporting means comprising a framework and said grippers and said moving means being mounted in said framework.

16. The calender of claim 15, wherein said framework comprises two interconnected sections, the grippers for the bearing for one end portion of each exchangeable roll being provided on one of said sections and the grippers for the bearing for the other end portion of each of said exchangeable rolls being provided on the other of said sections.

17. The calender of claim 10, wherein the sections of said framework at least partially surround said frame.

18. The calender of claim 17, wherein said frame has apertures wherein said sockets are movable during shifting of said exchangeable rolls between their first and second positions and during movement of said transporting means relative to said frame.

19. The calender of claim 18, wherein said main roll has first and second end portions and further comprising additional bearings provided in said frame for the end portions of said main roll, said apertures being disposed at at least one first level and said main roll being disposed at a different second level.

20. The calender of claim 19, wherein said frame includes a plurality of spaced-apart frame members and said apertures are provided in at least one of said frame members.

21. The calender of claim 19, wherein said apertures include at least one first aperture at a level above and at least one second aperture at a level below said main roll.

22. The calender of claim 16, wherein said frame includes an upper portion having guide means for said framework, said framework being reciprocable along said guide means in parallelism with said main roll.

23. The calender of claim 22, wherein each section of said framework comprises web disposed at a level above said frame and two downwardly extending arms supported by said web and flanking said frame.

24. The calender of claim 16, further comprising guide means for said framework, said framework being movable along said guide means in parallelism with the axis of said main roll and each section of said framework including a web disposed at a level above said frame and two arms extending downwardly from said web, flanking said frame and arranged to move along said guide means.

25. The calender of claim 15, further comprising a rack having means for receiving bearings from the grippers on said framework.

26. The calender of claim 25, wherein the mutual positions of said receiving means correspond to mutual positions of said sockets in the second positions of the respective exchangeable rolls.

27. The calender of claim 25, wherein said rack is a mobile rack which is movable between a plurality of different positions with reference to said frame.

28. The calender of claim 27, further comprising guide means defining a predetermined path for movement of said rack between said plurality of positions.

29. The calender of claim 28, further comprising means for separating a first station which is occupied by said frame from a second station for maintenance and/or inspection and/or storage of exchangeable rolls, said guide means being arranged to guide said rack for movement between said stations.

30. The calender of claim 29, further comprising a second rack having means for receiving bearings from the grippers on said framework and means for automatically moving said racks between said stations in response to initiation of the exchange of at least one exchangeable roll.

31. The calender of claim 30, wherein said racks flank said frame while occupying said first station and said transporting means is movable from a first position of register with said frame to discrete second positions of register with each of said racks.

32. The calender of claim 25, wherein said transporting means is arranged to move one or more exchangeable rolls between a position adjacent to the sockets on said frame and a position adjacent to the receiving means of said rack.

33. The calender of claim 15, wherein said framework includes two parts and each of said parts is provided with sets of grippers and moving means.

34. The calender of claim 33, wherein said parts of said framework are positioned to support at least two axially aligned exchangeable rolls.

35. The calender of claim 34, further comprising control means for operating the moving means of one of said sets substantially simultaneously with the moving means of the other of said sets.

36. A calender, comprising a frame; a roll assembly including a main roll in said frame and four parallel exchangeable rolls each having first and second end portions; means for shifting said exchangeable rolls in parallelism with said main roll between first positions of engagement with and second positions remote from said main roll, each of said exchangeable rolls defining with said main roll an elongated nip in the first position thereof; bearings provided on the end portions of said exchangeable rolls; sockets removably receiving said bearings; grippers movable into and from engagement with said bearing; means for moving said grippers with reference to said frame so as to move said bearings into and out of the respective sockets; and means for jointly transporting said exchangeable rolls with reference to said main roll subsequent to shifting of said exchangeable rolls to their second positions, said grippers and said moving means being mounted on said transporting means.

37. A calender, comprising a frame; a roll assembly including a main roll in said frame and a plurality of exchangeable rolls each having first and second end portions; means for shifting said exchangeable rolls in parallelism with said main roll between first positions of engagement with and second positions remote from said main roll; bearings provided on the end portions of said exchangeable rolls; sockets removably receiving said bearings; grippers movable into and from engagement with said bearings; means for moving said grippers with reference to said frame so as to move said bearings into and out of the respective sockets; and means for jointly transporting said exchangeable rolls with reference to said main roll subsequent to shifting of said exchangeable rolls to their second positions, said grippers and said moving being mounted on said transporting means.

38. The calender of claim 37, further comprising conduit means including first portions in said exchangeable roll and second portions in said frame and coupling means for said portions of said conduit means including a first component on said exchangeable roll and a second component separably connected with said first component and mounted in said frame, said first and second components being respectively connected to the first and second portions of said conduits.

39. The calender of claim 38, further comprising a device for attaching said components to and for detaching said components from each other.

40. The calender of claim 37, further comprising signal generating sensor means for monitoring the condition of said exchangeable roll and switching means for initiating the exchange of such roll in response to signals from said sensor means.

41. The calender of claim 40, further comprising means for comparing the signals from said sensor means with predetermined reference signals and for operating said switching means in response to predetermined deviation of signals which are generated by said sensor means from said reference signals.

42. A calender, comprising a frame; a roll assembly including a main roll at least one exchangeable roll having first and second end portions; means for moving said exchangeable roll in parallelism with said main roll between a first position of engagement with and a second position remote from said main roll; bearings provided on the end portions of said exchangeabie roll; sockets removably receiving said bearings; grippers movable into and from engagement with said bearings; means for moving said grippers with reference to said frame so as to move said bearings into and out of the respective sockets; and means for transporting said exchangeable roll with reference to said main roll subsequent to shifting of said exchangeable roll to said second position, said grippers and said moving means being mounted on said transporting means.

* * * * *